US008165875B2

(12) United States Patent
Hetherington et al.

(10) Patent No.: US 8,165,875 B2
(45) **Date of Patent: *Apr. 24, 2012**

(54) SYSTEM FOR SUPPRESSING WIND NOISE

(75) Inventors: Phillip A. Hetherington, Port Moody (CA); Xueman Li, Burnaby (CA); Pierre Zakarauskas, Vancouver (CA)

(73) Assignee: QNX Software Systems Limited, Kanata, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/902,503

(22) Filed: Oct. 12, 2010

(65) Prior Publication Data

US 2011/0026734 A1 Feb. 3, 2011

Related U.S. Application Data

(63) Continuation of application No. 10/688,802, filed on Oct. 16, 2003, now Pat. No. 7,895,036, which is a continuation-in-part of application No. 10/410,736, filed on Apr. 10, 2003, now Pat. No. 7,885,420.

(51) Int. Cl.
*G10L 21/02* (2006.01)

(52) U.S. Cl. ..... 704/233; 704/226; 381/94.8

(58) Field of Classification Search ..... 704/226, 704/233; 381/94.8

See application file for complete search history.

(56) References Cited

U.S. PATENT DOCUMENTS 4,486,900 A 12/1984 Cox et al.
4,531,228 A 7/1985 Noso et al.
4,630,304 A 12/1986 Borth et al.
4,811,404 A 3/1989 Vilmur et al.
4,843,562 A 6/1989 Kenyon et al.
4,845,466 A 7/1989 Hariton et al.
4,959,865 A * 9/1990 Stettiner et al. ..... 704/233
5,012,519 A 4/1991 Adlersberg et al.
5,027,410 A 6/1991 Williamson et al.
5,056,150 A 10/1991 Yu et al.
5,146,539 A 9/1992 Doddington et al.
5,251,263 A 10/1993 Andrea et al.
5,313,555 A 5/1994 Kamiya
5,400,409 A 3/1995 Linhard
5,426,703 A 6/1995 Hamabe et al.
5,426,704 A 6/1995 Tamamura et al.

(Continued)

FOREIGN PATENT DOCUMENTS

CA 2158847 9/1994

(Continued)

OTHER PUBLICATIONS

European Search Report for Application No. 04003675.8-2218; May 12, 2004.

(Continued)

*Primary Examiner* — Daniel D Abebe
(74) *Attorney, Agent, or Firm* — Brinks Hofer Gilson & Lione

(57) ABSTRACT

A voice enhancement logic improves the perceptual quality of a processed voice. The voice enhancement system includes a noise detector and a noise attenuator. The noise detector detects a wind buffet and a continuous noise by modeling the wind buffet. The noise attenuator dampens the wind buffet to improve the intelligibility of an unvoiced, a fully voiced, or a mixed voice segment.

20 Claims, 15 Drawing Sheets

U.S. PATENT DOCUMENTS 5,442,712 A 8/1995 Kawamura et al.
5,479,517 A 12/1995 Linhard
5,485,522 A 1/1996 Solve et al.
5,495,415 A 2/1996 Ribbens et al.
5,502,688 A 3/1996 Recchione et al.
5,526,466 A 6/1996 Takizawa
5,550,924 A 8/1996 Heif et al.
5,568,559 A 10/1996 Makino
5,574,824 A * 11/1996 Slyh et al. ..... 704/226
5,584,295 A 12/1996 Muller et al.
5,586,028 A 12/1996 Sekine et al.
5,617,508 A 4/1997 Reavers
5,651,071 A 7/1997 Lindemann et al.
5,677,987 A 10/1997 Seki et al.
5,680,508 A 10/1997 Liu
5,692,104 A 11/1997 Chow et al.
5,701,344 A 12/1997 Wakui
5,727,072 A 3/1998 Raman
5,752,226 A 5/1998 Chan et al.
5,809,152 A 9/1998 Nakamura et al.
5,839,101 A 11/1998 Vähätalo et al.
5,859,420 A 1/1999 Borza
5,878,389 A 3/1999 Hermansky et al.
5,920,834 A 7/1999 Sih et al.
5,933,495 A 8/1999 Oh
5,933,801 A 8/1999 Fink et al.
5,949,888 A 9/1999 Gupta et al.
5,982,901 A 11/1999 Kane et al.
6,011,853 A 1/2000 Koski et al.
6,108,610 A 8/2000 Winn
6,122,384 A 9/2000 Mauro
6,130,949 A 10/2000 Aoki et al.
6,163,608 A 12/2000 Romesburg et al.
6,167,375 A 12/2000 Miseki et al.
6,173,074 B1 1/2001 Russo
6,175,602 B1 1/2001 Gustafsson et al.
6,192,134 B1 2/2001 White et al.
6,199,035 B1 3/2001 Lakaniemi et al.
6,208,268 B1 3/2001 Scarzello et al.
6,230,123 B1 5/2001 Mekuria et al.
6,252,969 B1 6/2001 Ando
6,289,309 B1 9/2001 deVries
6,405,168 B1 6/2002 Bayya et al.
6,415,253 B1 7/2002 Johnson
6,434,246 B1 8/2002 Kates et al.
6,453,285 B1 9/2002 Anderson et al.
6,507,814 B1 1/2003 Gao
6,510,408 B1 1/2003 Hermansen
6,587,816 B1 7/2003 Chazan et al.
6,615,170 B1 9/2003 Liu et al.
6,643,619 B1 11/2003 Linhard et al.
6,647,365 B1 11/2003 Faller
6,687,669 B1 2/2004 Schrögmeier et al.
6,711,536 B2 3/2004 Rees
6,741,873 B1 5/2004 Doran et al.
6,766,292 B1 7/2004 Chandran et al.
6,768,979 B1 7/2004 Menéndez-Pidal et al.
6,782,363 B2 8/2004 Lee et al.
6,822,507 B2 11/2004 Buchele
6,859,420 B1 2/2005 Coney et al.
6,882,736 B2 4/2005 Dickel et al.
6,910,011 B1 6/2005 Zakarauskas
6,937,980 B2 8/2005 Krasny et al.
6,959,276 B2 10/2005 Droppo et al.
7,043,030 B1 5/2006 Furuta
7,047,047 B2 5/2006 Acero et al.
7,062,049 B1 6/2006 Inoue et al.
7,072,831 B1 7/2006 Etter
7,092,877 B2 8/2006 Ribic
7,117,145 B1 10/2006 Venkatesh et al.
7,117,149 B1 10/2006 Zakarauskas
7,158,932 B1 1/2007 Furuta
7,165,027 B2 1/2007 Kellner et al.
7,313,518 B2 12/2007 Scalart et al.
7,373,296 B2 5/2008 Van De Par et al.
7,386,217 B2 6/2008 Zhang
2001/0028713 A1 10/2001 Walker
2002/0037088 A1 3/2002 Dickel et al.
2002/0071573 A1 6/2002 Finn
2002/0094100 A1 7/2002 Kates et al.
2002/0094101 A1 7/2002 De Roo et al.
2002/0176589 A1 11/2002 Buck et al.
2003/0040908 A1 2/2003 Yang et al.
2003/0147538 A1 8/2003 Elko
2003/0151454 A1 8/2003 Buchele
2003/0216907 A1 11/2003 Thomas
2004/0078200 A1 4/2004 Alves
2004/0093181 A1 5/2004 Lee
2004/0138882 A1 7/2004 Miyazawa
2004/0161120 A1 8/2004 Petersen et al.
2004/0165736 A1 8/2004 Hetherington et al.
2004/0167777 A1 8/2004 Hetherington et al.
2005/0114128 A1 5/2005 Hetherington et al.
2005/0238283 A1 10/2005 Faure et al.
2005/0240401 A1 10/2005 Ebenezer
2006/0034447 A1 2/2006 Alves et al.
2006/0074646 A1 4/2006 Alves et al.
2006/0100868 A1 5/2006 Hetherington et al.
2006/0115095 A1 6/2006 Giesbrecht et al.
2006/0116873 A1 6/2006 Hetherington et al.
2006/0136199 A1 6/2006 Nongpiur et al.
2006/0251268 A1 11/2006 Hetherington et al.
2006/0287859 A1 12/2006 Hetherington et al.
2007/0019835 A1 1/2007 Ivo de Roo et al.
2007/0033031 A1 2/2007 Zakarauskas

FOREIGN PATENT DOCUMENTS

CA 2157496 10/1994
CA 2158064 10/1994
CN 1325222 A 12/2001
EP 0 076 687 A1 4/1983
EP 0 629 996 A2 12/1994
EP 0 629 996 A3 12/1994
EP 0 750 291 A1 12/1996
EP 1 450 353 A1 8/2004
EP 1 450 354 A1 8/2004
EP 1 669 983 A1 6/2006
JP 64-039195 2/1989
JP 6282297 10/1994
JP 6319193 11/1994
JP 6349208 12/1994
JP 2002-261530 A 9/2000
JP 2001-215992 8/2001
JP 2001-350498 A 12/2001
KR 138806 B1 6/1998
WO WO 00/41169 A1 7/2000
WO WO 0156255 A1 8/2001
WO WO 01/73761 A1 10/2001

OTHER PUBLICATIONS

Avendano C., Hermansky, H., "Study on the Dereverberation of Speech Based on Temporal Envelope Filtering," Proc. ICSLP '96, pp. 889-892, Oct. 1996.

Berk et al.; "Data Analysis with Microsoft Excel"; Duxbury Press; 1998; pp. 236-239, and 256-259.

Boll, S.F., "Suppression of Acoustic Noise in Speech Using Spectral Subtraction,"*IEEE Trans. on Acoustics, Speech, and Signal Processing*, vol. ASSP-27, No. 2, 1979, pp. 113-120.

Ephraim, Statistical-Model-Based Speech Enhancement Systems, Proceedings of the IEEE, vol. 80, No. 10, Oct. 1992, pp. 1526-1555.

Fiori, S., Uncini, A., and Piazza F., "Blind Deconvloution by Modified Bussgang Algorithm", Dept. of Electronics and Automatics—University of Ancona (Italy), ISCAS 1999.

Godsill et al., Digital Audio Restoration, Jun. 2, 1997, pp. 1-71.

Learned, R.E. et al., A Wavelet Packet Approach to Transient Signal Classification, Applied and Computational Harmonic Analysis, Jul. 1995, pp. 265-278, vol. 2, No. 3, USA, XP 000972660. ISSN: 1063-5203. abstract.

Ljung, Lennart; "System Identification Theory for the User"; Prentice Hall; 1999; pp. 1-14.

Nakatani, T., Miyoshi, M., and Kinoshita, K., "Implementation and Effects of Single Channel Dereverberation Based on the Harmonic Structure of Speech, " Proc. of IWAENC-2003, pp. 91-94, Sep. 2003.

Patent Abstracts of Japan; vol. 18, No. 681; Dec. 21, 1994; JP 06 269084; Sep. 22, 1994.

Pellom et al.; An Improved (Auto:I LSP:T) Constrained Iterative Speech Enhancement for Colored Noise Environments, IEEE Transactions on Speech and Audio Processing, vol. 6, No. 6, Nov. 1998, pp. 573-579.

Purder, H. et al.; "Improved Noise Reduction for Hands-Free Car Phones Utilizing Information on Vehicle and Engine Speeds"; Sep. 4-8, 2000; pp. 1851-1854, vol. 3; XP0009030255; 2000; Tampere, Finland, Tampere Univeristy Technology; Finalnd; Abstract.

Quatieri, T.F. et al., Noise Reduction Using a Soft-Dection/Decision Sine-Wave Vector Quantizer, International Conference on Acoustics, Speech & Signal Processing, Apr. 3, 1990, pp. 821-824, vol. Conf. 15, IEEE ICASSP, New York, US XP000146895, abstract, Paragraph 3.1.

Quelavoine, R. et al., Transients Recognition in Underwater Acoustic with Multilayer Neural Networks, Engineering Benefits from Neural Networks, Proceedings of the International Conference EANN 1998, Gibraltar, Jun. 10-12, 1998 pp. 330-333, XP000974500. 1998, Turku, Finland, Syst. Eng. Assoc., Finland. ISBN: 951-97868-0-5. abstract. p. 30 paragraph 1.

Seely, S.; "An Introduction to Engineering Systems"; Peramon Press Inc.; 1972; pp. 7-10.

Shust, Michael R. and Rogers, James C., "Active Removal of Wind Noise From Outdoor Microphones Using Local Velocity Measurements", *J. Acoust. Soc. Am.*, vol. 104, No. 3, 1998, 1 page. Complete article obtained from the Internet on Jul. 28, 2004 at:<http://www.acounstics.org/press/136th/mshust.htm >, 6 pages.

Shust, Michael R. and Rogers, James C., Abstract of "Active Removal of Wind Noise From Outdoor Microphones Using Local Velocity Measurements", *J. Acoust. Soc. Am.*, vol. 104, No. 3, Pt. 2, 1998, 1 page.

Simon, G., Dectection of Harmonic Burst Signals, International Journal Circuit Theory and Applications, Jul. 1985, vol. 13, No. 3, pp. 195-201. UK, XP 000974305. ISSN: 0098-9886. abstract.

Udrea, R. M. et al., "Speech Enchancement Using Spectral Over-Subtraction and Residual Noise Reduction, " *IEEE*, 2003, pp. 165-168.

Vaseghi, Advance Digital Signal Processing and Noise Reduction, Second Edition, John Wiley & Sons, 2000, pp. 1-395.

Vaseghi, S. V., Chapter 12 "Implusive Noise, " *Advanced Digital Signal Processing and Noise Reduction*, 2nd ed ., John Wiley and Sons, Copyright 2000, pp. 355-377.

Vieira, J., "Automatic Estimation of Reverberation Time, " Audio Engineering Society Convention Paper 6107, 116th Convention, May 8-11, 2004, Berlin, Germany, pp. 1-7.

Wahab, A., et al.; "Intelligent Dashboard with Speech Enhacement"; Information, Communications and Signal Processing; 1997; ICICS.; Proceedings of 1997 International Conference on Singapore; Sep. 9-12, 1997; New York, NY, USA; IEEE, pp. 993-997.

Zakasrauskas, P., Detection and Localization of Nondeterministic Transients in Time series and Application to Ice-Cracking Sound, Digital Signal Processing, 1993, vol. 3, No. 1, pp. 36-45, Academic Press, Orlando, FL, USA, XP 000361270, ISSN: 1051-2004. Entire document.

* cited by examiner

SYSTEM FOR SUPPRESSING WIND NOISE

PRIORITY CLAIM

This application is a continuation of U.S. application Ser. No. 10/688,802, "System for Suppressing Wind Noise," filed Oct. 16, 2003 now U.S. Pat. No. 7,895,036, which is a continuation in-part of U.S. application Ser. No. 10/410,736, "Method and Apparatus for Suppressing Wind Noise," filed Apr. 10, 2003 now U.S. Pat. No. 7,885,420. The disclosure of each of these applications is incorporated herein by reference.

BACKGROUND OF THE INVENTION

1. Technical Field

This invention relates to acoustics, and more particularly, to a system that enhances the perceptual quality of a processed voice.

2. Related Art

Many hands-free communication devices acquire, assimilate, and transfer a voice signal. Voice signals pass from one system to another through a communication medium. In some systems, including some used in vehicles, the clarity of the voice signal does not depend on the quality of the communication system or the quality of the communication medium. When noise occurs near a source or a receiver, distortion garbles the voice signal, destroys information, and in some instances, masks the voice signal so that it is not recognized by a listener.

Noise, which may be annoying, distracting, or results in a loss of information, may come from many sources. Within a vehicle, noise may be created by the engine, the road, the tires, or by the movement of air. A natural or artificial movement of air may be heard across a broad frequency range. Continuous fluctuations in amplitude and frequency may make wind noise difficult to overcome and degrade the intelligibility of a voice signal.

Many systems attempt to counteract the effects of wind noise. Some systems rely on a variety of sound-suppressing and dampening materials throughout an interior to ensure a quiet and comfortable environment. Other systems attempt to average out varying wind-induced pressures that press against a receiver. These noise reducers may take many shapes to filter out selected pressures making them difficult to design to the many interiors of a vehicle. Another problem with some speech enhancement systems is that of detecting wind noise in a background of a continuous noise. Yet another problem with some speech enhancement systems is that they do not easily adapt to other communication systems that are susceptible to wind noise.

Therefore there is a need for a system that counteracts wind noise across a varying frequency range.

SUMMARY

A voice enhancement logic improves the perceptual quality of a processed voice. The system learns, encodes, and then dampens the noise associated with the movement of air from an input signal. The system includes a noise detector and a noise attenuator. The noise detector detects a wind buffet by modeling. The noise attenuator then dampens the wind buffet.

Alternative voice enhancement logic includes time frequency transform logic, a background noise estimator, a wind noise detector, and a wind noise attenuator. The time frequency transform logic converts a time varying input signal into a frequency domain output signal. The background noise estimator measures the continuous noise that may accompany the input signal. The wind noise detector automatically identifies and models a wind buffet, which may then be dampened by the wind noise attenuator.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

A voice enhancement logic improves the perceptual quality of a processed voice. The logic may automatically learn and encode the shape and form of the noise associated with the movement of air in a real or a delayed time. By tracking selected attributes, the logic may eliminate or dampen wind noise using a limited memory that temporarily stores the selected attributes of the noise. Alternatively, the logic may also dampen a continuous noise and/or the "musical noise," squeaks, squawks, chirps, clicks, drips, pops, low frequency tones, or other sound artifacts that may be generated by some voice enhancement systems.

Figure 1:
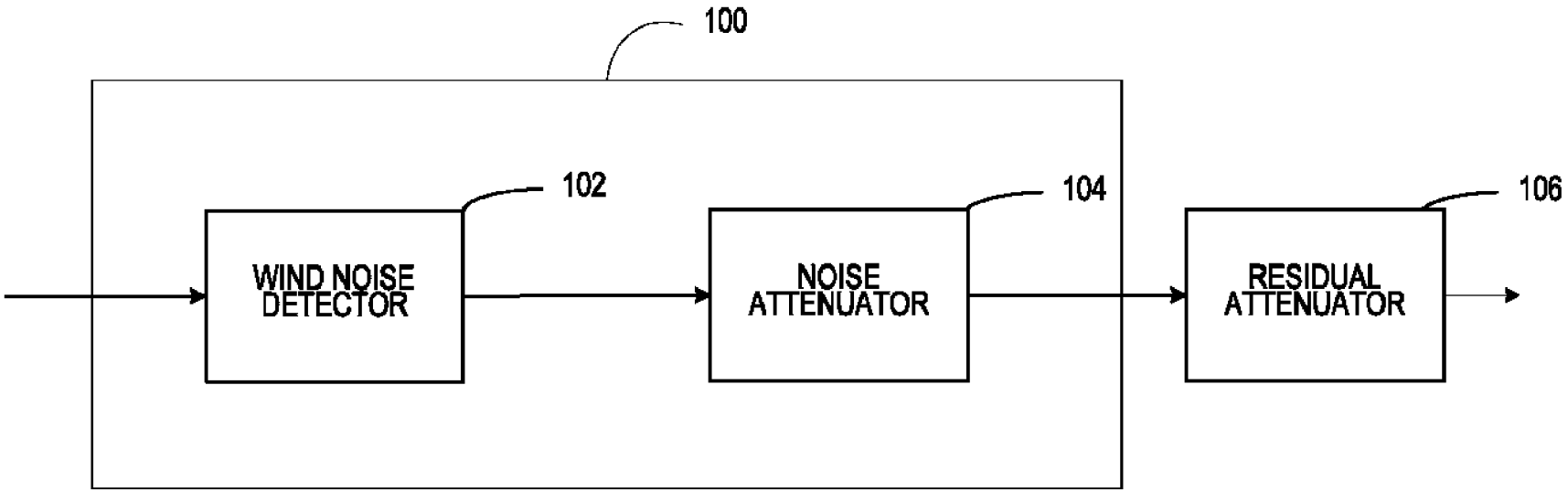
FIG. 1 is a partial block diagram of voice enhancement logic.

FIG. 1 is a partial block diagram of the voice enhancement logic 100. The voice enhancement logic may encompass hardware or software that is capable of running on one or more processors in conjunction with one or more operating systems. The highly portable logic includes a wind noise detector 102 and a noise attenuator 104.

In FIG. 1 the wind noise detector 102 may identify and model a noise associated with wind flow from the properties of air. While wind noise occurs naturally or may be artificially generated over a broad frequency range, the wind noise detector 102 is configured to detect and model the wind noise that is perceived by the ear. The wind noise detector receives incoming sound, that in the short term spectra, may be classified into three broad categories: (1) unvoiced, which exhibits noise-like characteristics that includes the noise associated with wind, i.e., it may have some spectral shape but no harmonic or formant structure; (2) fully voiced, which exhibits a regular harmonic structure, or peaks at pitch harmonics weighted by the spectral envelope that may describe the formant structure, and (3) mixed voice, which exhibits a mixture of the above two categories, some parts containing noise-like segments, the rest exhibiting a regular harmonic structure and/or a formant structure.

The wind noise detector 102 may separate the noise-like segments from the remaining signal in a real or in a delayed time no matter how complex or how loud an incoming segment may be. The separated noise-like segments are analyzed to detect the occurrence of wind noise, and in some instances, the presence of a continuous underlying noise. When wind noise is detected, the spectrum is modeled, and the model is retained in a memory. While the wind noise detector 102 may store an entire model of a wind noise signal, it also may store selected attributes in a memory.

To overcome the effects of wind noise, and in some instances, the underlying continuous noise that may include ambient noise, the noise attenuator 104 substantially removes or dampens the wind noise and/or the continuous noise from the unvoiced and mixed voice signals. The voice enhancement logic 100 encompasses any system that substantially removes or dampens wind noise. Examples of systems that may dampen or remove wind noise include systems that use a signal and a noise estimate such as (1) systems which use a neural network mapping of a noisy signal and an estimate of the noise to a noise-reduced signal, (2) systems which subtract the noise estimate from a noisy-signal, (3) systems that use the noisy signal and the noise estimate to select a noise-reduced signal from a code-book, (4) systems that in any other way use the noisy signal and the noise estimate to create a noise-reduced signal based on a reconstruction of the masked signal. These systems may attenuate wind noise, and in some instances, attenuate the continuous noise that may be part of the short-term spectra. The noise attenuator 104 may also interface or include an optional residual attenuator 106 that removes or dampens artifacts that may result in the processed signal. The residual attenuator 106 may remove the "musical noise," squeaks, squawks, chirps, clicks, drips, pops, low frequency tones, or other sound artifacts.

Figure 2:
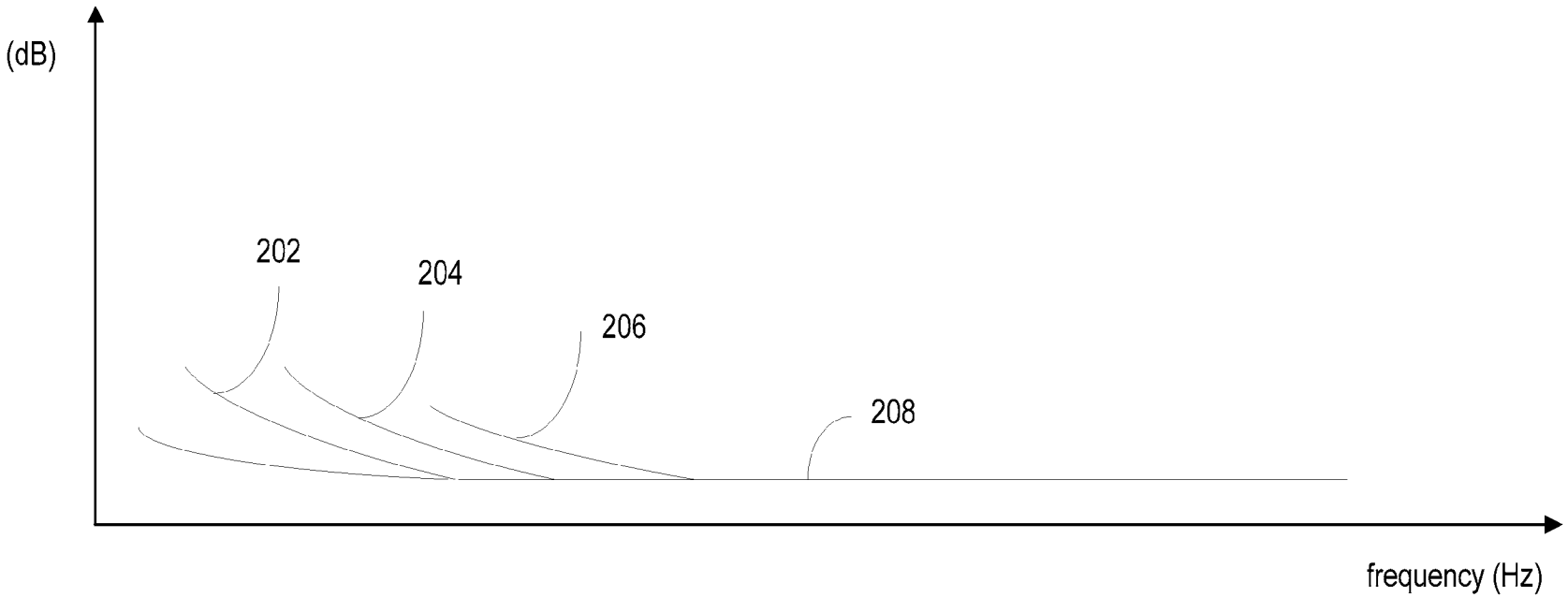
FIG. 2 is noise that may be associated with wind and other sources in the frequency domain.

FIG. 2 illustrates exemplary noise associated with three wind flows. The wind buffets 202, 204, and 206, which are the events of wind striking a detector, vary by their level of severity or amplitude. The amplitudes reflect the relative differences in power or intensity between the fluctuations of air pressure received across an input area of a receiver or a detector. The line underlying the wind buffets illustrates the continuous noise 208 that is also sensed by the receiver or detector. In a vehicle, wind buffets may represent the natural flow of air through a window, through an open top of a convertible, through an inlet, or the artificial movement of air caused by a fan or a heating, ventilating, and/or air conditioning system (HVAC). The continuous noise may represent an ambient noise or a noise associated with an engine, a powertrain, a road, tires, or other sounds.

In the time and frequency spectral domain, the continuous noise 208 and a wind buffet 202 may be curvilinear. The continuous noise and wind buffet may appear to be formed or characterized by the curved lines shown in FIG. 2. However, when the signal strength (in decibels) of the wind buffet (e.g., $\sigma_{WB}$) is related to the signal strength of a continuous noise (e.g., $\sigma_{CN}$) in the signal-to-noise ratio (SNR) domain, the wind buffet 202 may be characterized by a linear function with a vertical dimension corresponding to decibels and a horizontal dimension corresponding to frequency. This relation may be expressed as:

$$\mathrm{SNR}=\sigma_{WB}-\sigma_{CN} \qquad \text{(Equation 1)}$$

Figure 3:
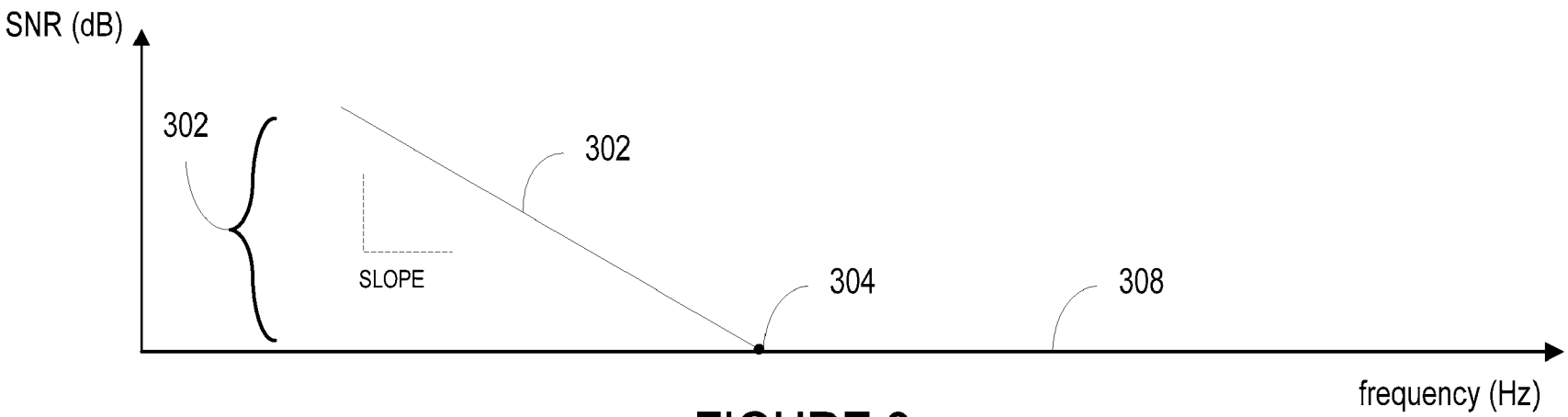
FIG. 3 is a signal-to-noise ratio of the noise that may be associated with wind and other sources in the frequency domain.

Any method may approximate the linearity of a wind buffet. In the signal-to-noise domain, an offset or y-intercept 302 and an x-intercept or pivot point may characterize the linear model 302. Alternatively, an x or y-coordinate and a slope may model the wind buffet. In FIG. 3, the linear model 302 descends in a negative slope.

Figure 4:
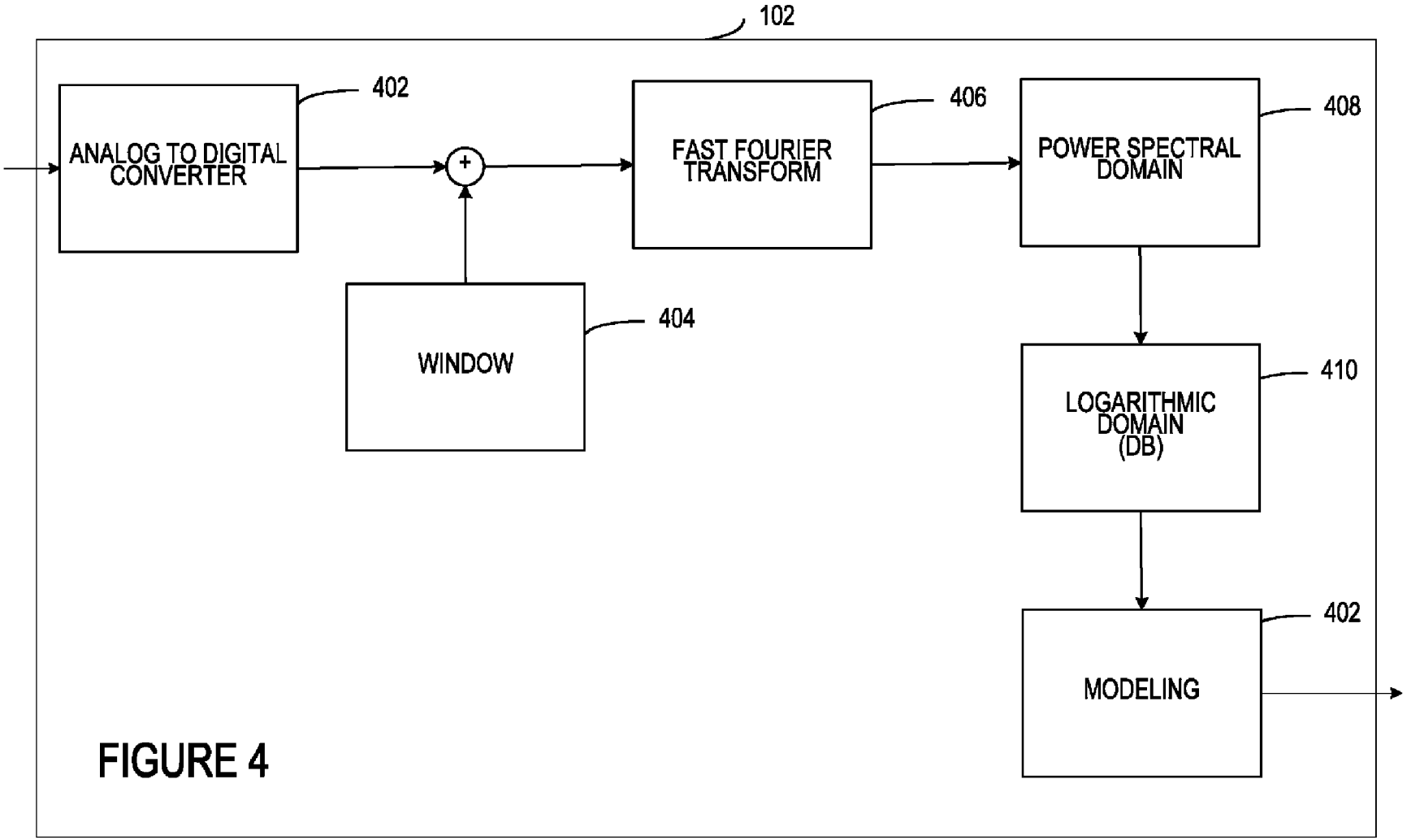
FIG. 4 is a block diagram of the voice enhancement logic of FIG. 1.

FIG. 4 is a block diagram of an example wind noise detector 102 that may receive or detect an unvoiced, fully voiced, or a mixed voice input signal. A received or detected signal is digitized at a predetermined frequency. To assure a good quality voice, the voice signal is converted to a pulse-code-modulated (PCM) signal by an analog-to-digital converter 402 (ADC) having any common sample rate. A smooth window 404 is applied to a block of data to obtain the windowed signal. The complex spectrum for the windowed signal may be obtained by means of a fast Fourier transform (FFT) 406 that separates the digitized signals into frequency bins, with each bin identifying an amplitude and phase across a small frequency range. Each frequency bin may then be converted into the power-spectral domain 408 and logarithmic domain 410 to develop a wind buffet and continuous noise estimate. As more windows of sound are processed, the wind noise detector 102 may derive average noise estimates. A time-smoothed or weighted average may be used to estimate the wind buffet and continuous noise estimates for each frequency bin.

To detect a wind buffet, a line may be fitted to a selected portion of the low frequency spectrum in the SNR domain. Through a regression, a best-fit line may measure the severity of the wind noise within a given block of data. A high correlation between the best-fit line and the low frequency spectrum may identify a wind buffet. Whether or not a high correlation exists, may depend on a desired clarity of a processed voice and the variations in frequency and amplitude of the wind buffet. Alternatively, a wind buffet may be identified when an offset or y-intercept of the best-fit line exceeds a predetermined threshold (e.g., >3 dB).

To limit a masking of voice, the fitting of the line to a suspected wind buffet signal may be constrained by rules. Exemplary rules may prevent a calculated offset, slope, or coordinate point in a wind buffet model from exceeding an average value. Another rule may prevent the wind noise detector 102 from applying a calculated wind buffet correction when a vowel or another harmonic structure is detected. A harmonic may be identified by its narrow width and its sharp peak, or in conjunction with a voice or a pitch detector. If a vowel or another harmonic structure is detected, the wind noise detector may limit the wind buffet correction to values less than or equal to average values. An additional rule may allow the average wind buffet model or its attributes to be updated only during unvoiced segments. If a voiced or a mixed voice segment is detected, the average wind buffet model or its attributes are not updated under this rule. If no voice is detected, the wind buffet model or each attribute may be updated through any means, such as through a weighted average or a leaky integrator. Many other rules may also be applied to the model. The rules may provide a substantially good linear fit to a suspected wind buffet without masking a voice segment.

Figure 9:
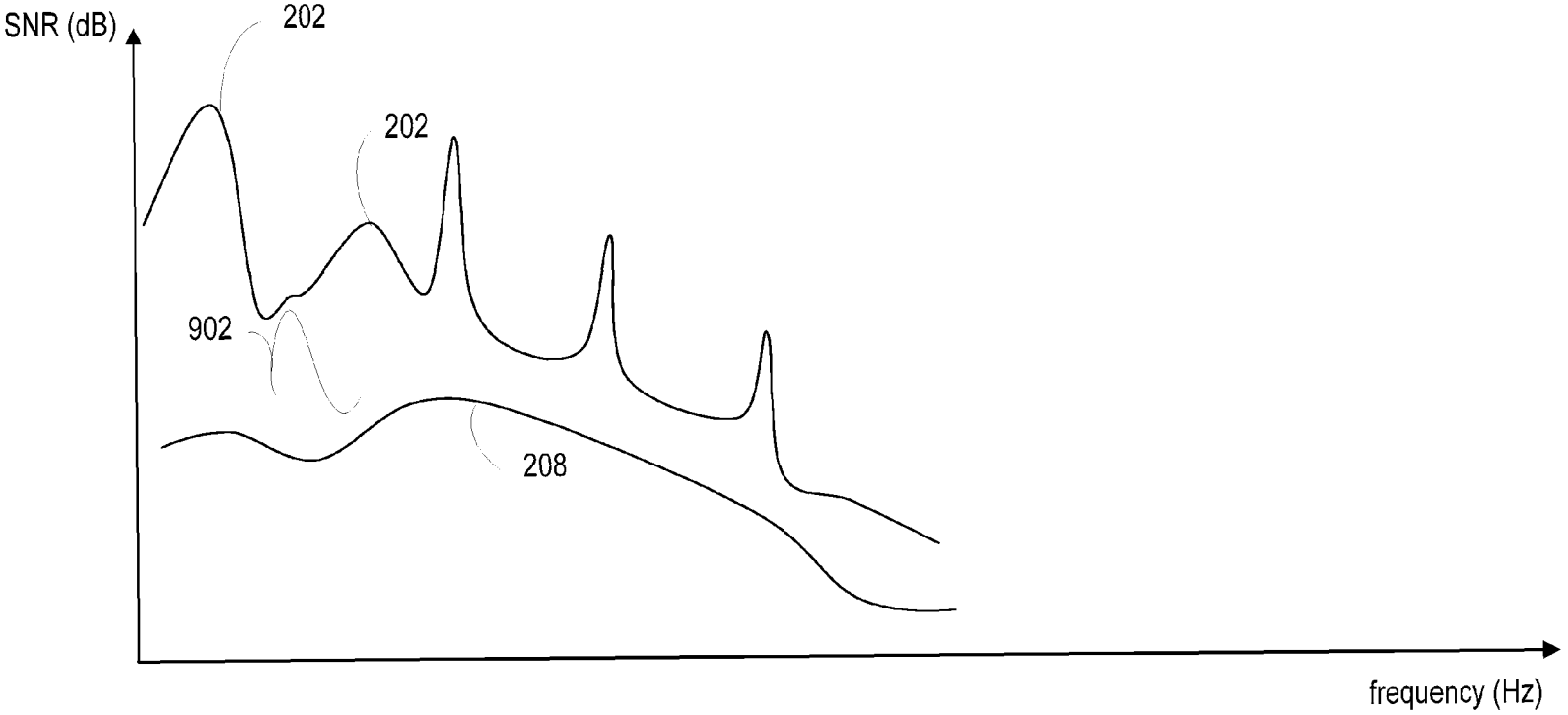
FIG. 9 is a graph of a wind buffet masking a portion of a voice signal.
Figure 10:
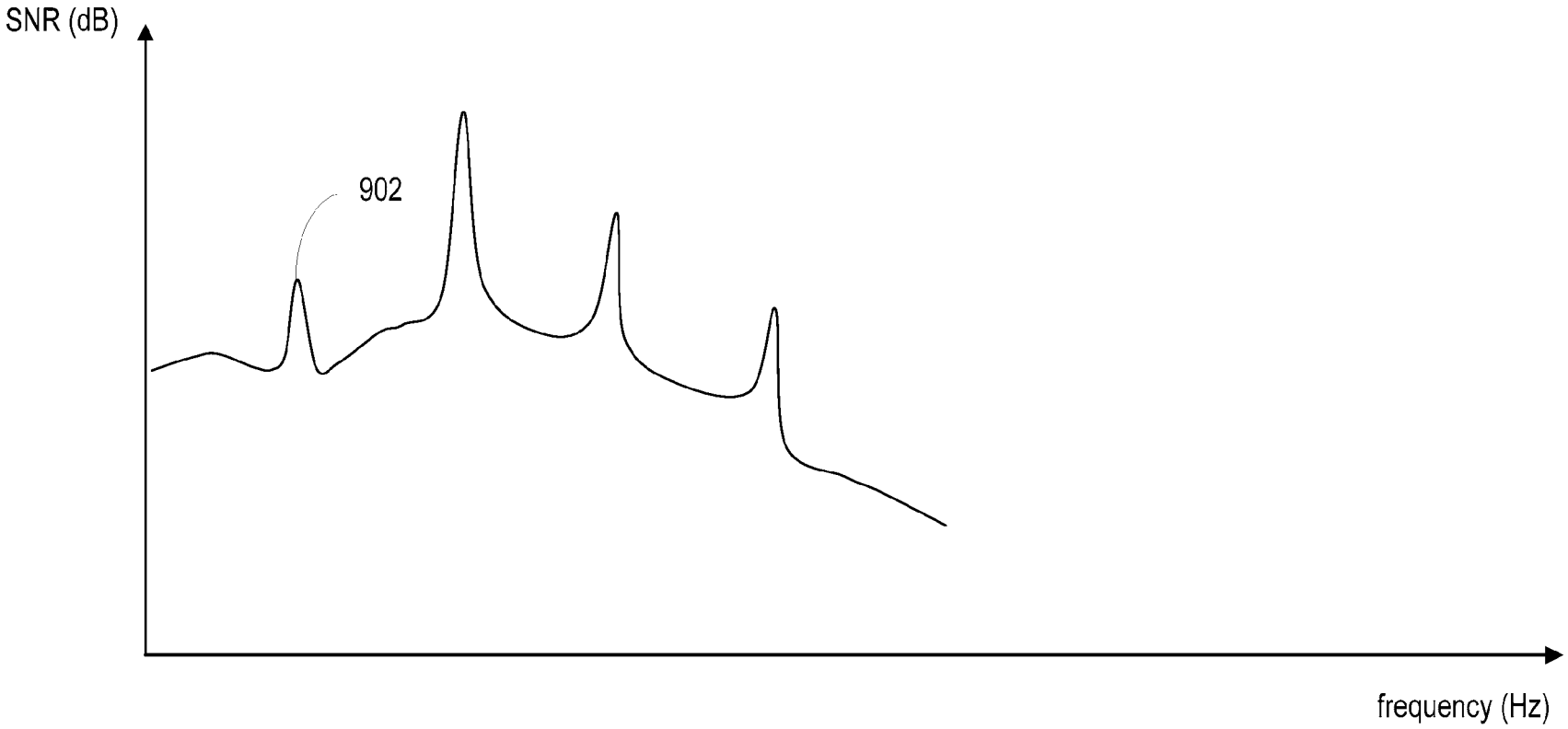
FIG. 10 is a graph of a processed and reconstructed voice signal.

To overcome the effects of wind noise, a wind noise attenuator 104 may substantially remove or dampen the wind buffet from the noisy spectrum by any method. One method may add the wind buffet model to a recorded or modeled continuous noise. In the power spectrum, the modeled noise may then be subtracted from the unmodified spectrum. If an underlying peak or valley 902 is masked by a wind buffet 202 as shown in FIG. 9 or masked by a continuous noise, a conventional or modified interpolation method may be used to reconstruct the peak and/or valley as shown in FIG. 10. A linear or step-wise interpolator may be used to reconstruct the missing part of the signal. An inverse FFT may then be used to convert the signal power to the time domain, which provides a reconstructed voice signal.

To minimize the "music noise," squeaks, squawks, chirps, clicks, drips, pops, low frequency tones, or other sound artifacts that may be generated in the low frequency range by some wind noise attenuators, an optional residual attenuator 106 (shown in FIG. 1) may also condition the voice signal before it is converted to the time domain. The residual attenuator 106 may track the power spectrum within a low frequency range (e.g., less than about 400 Hz). When a large increase in signal power is detected an improvement may be obtained by limiting or dampening the transmitted power in the low frequency range to a predetermined or calculated threshold. A calculated threshold may be equal to, or based on, the average spectral power of that same low frequency range at an earlier period in time.

Figure 5:
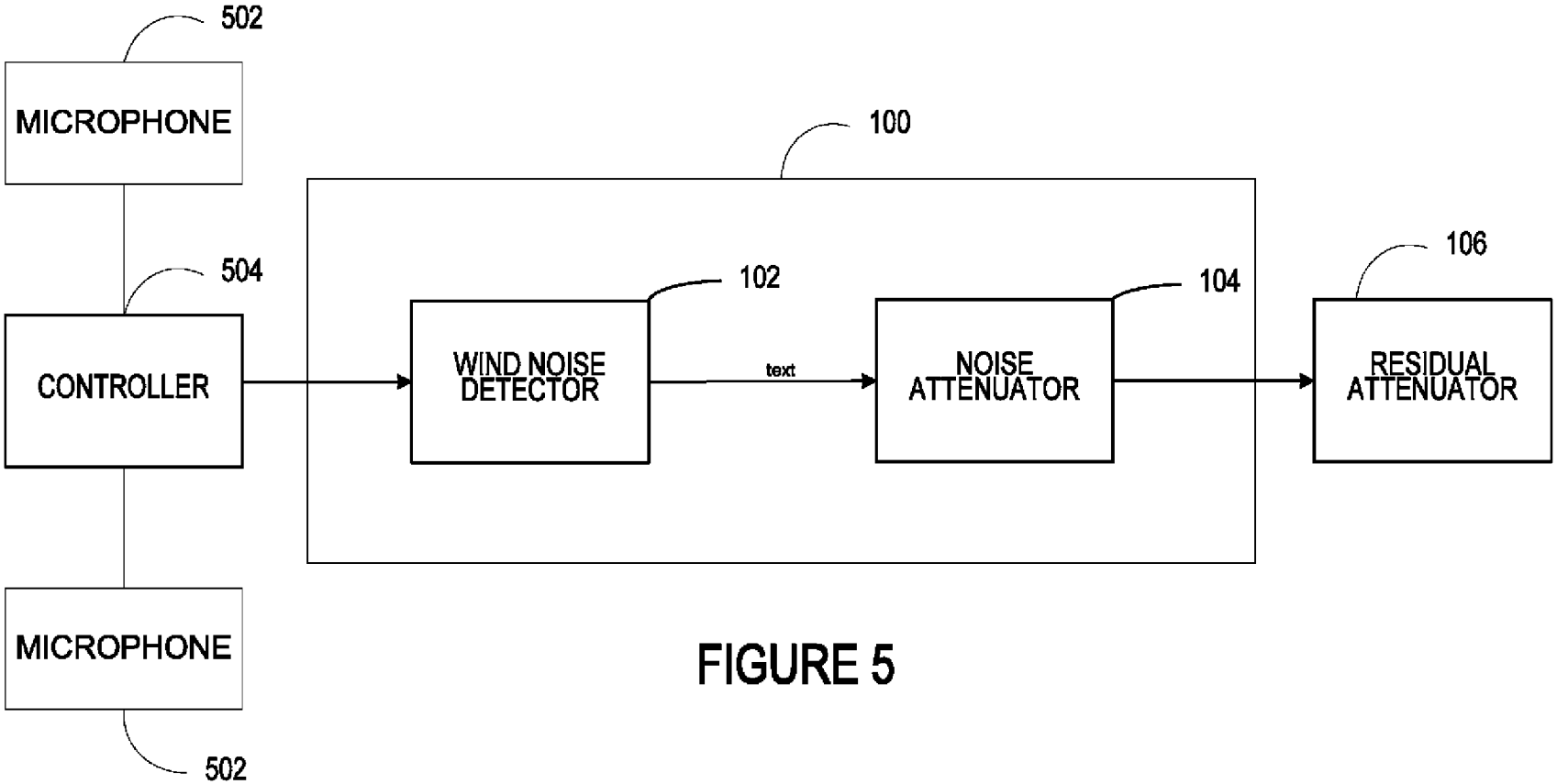
FIG. 5 is a pre-processing system coupled to the voice enhancement logic of FIG. 1.

Further improvements to voice quality may be achieved by pre-conditioning the input signal before the wind noise detector processes it. One pre-processing system may exploit the lag time that a signal may arrive at different detectors that are positioned apart as shown in FIG. 5. If multiple detectors or microphones 502 are used that convert sound into an electric signal, the pre-processing system may include control logic 504 that automatically selects the microphone 502 and channel that senses the least amount of noise. When another microphone 502 is selected, the electric signal may be combined with the previously generated signal before being processed by the wind noise detector 102.

Figure 6:
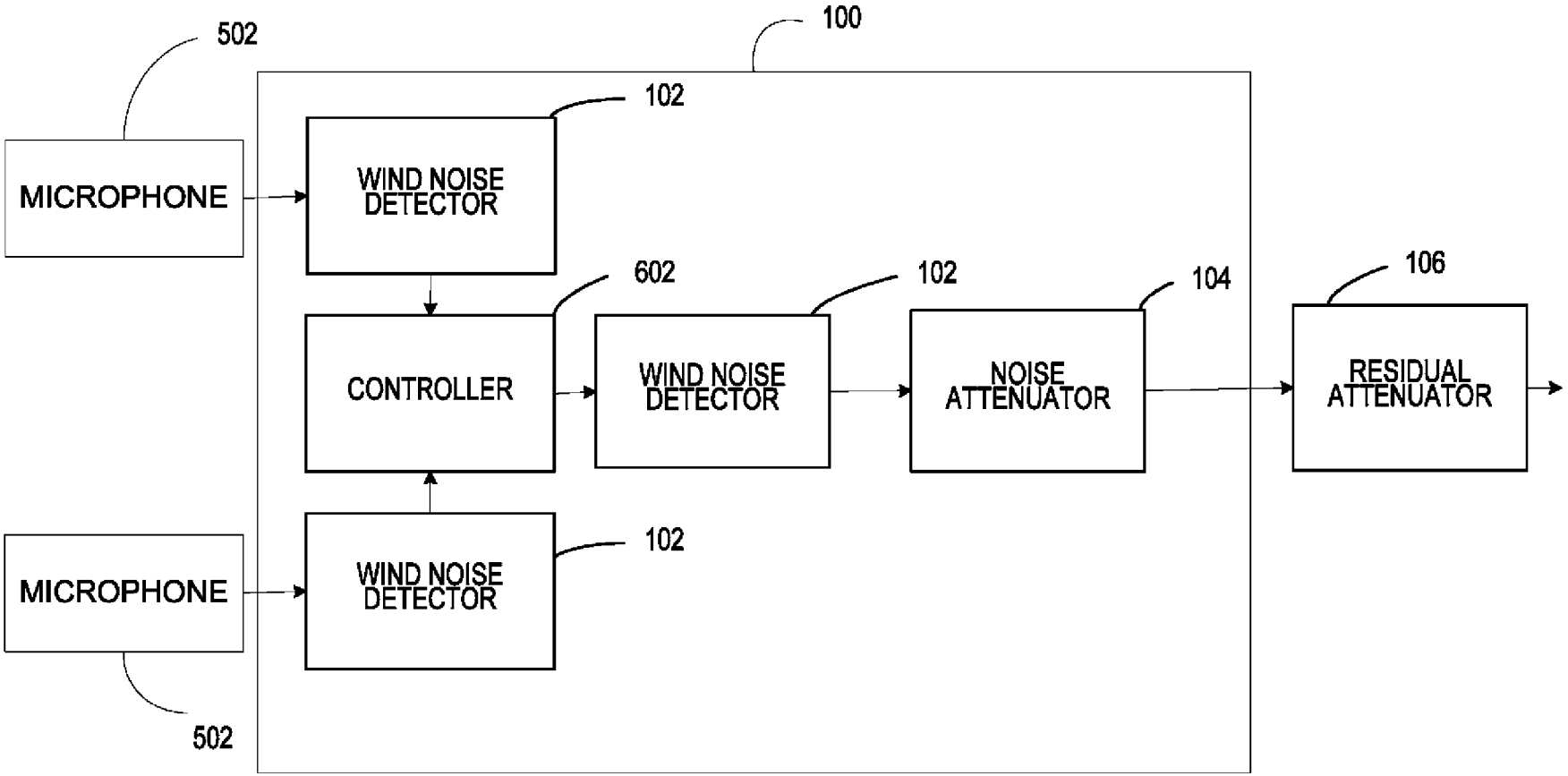
FIG. 6 is an alternative pre-processing system coupled to the voice enhancement logic of FIG. 1.

Alternatively, multiple wind noise detectors 102 may be used to analyze the input of each of the microphones 502 as shown in FIG. 6. Spectral wind buffet estimates may be made on each of the channels. A mixing of one or more channels may occur by switching between the outputs of the microphones 502. The signals may be evaluated and selected on a frequency-by-frequency basis until the frequency of the pivot point 304 (shown in FIG. 3) is reached. Alternatively, control logic 602 may combine the output signals of multiple wind noise detectors 102 at a specific frequency or frequency range through a weighting function. When the frequency of the pivot point is exceeded, the process may continue or a standard adaptive beam forming method may be used.

Figure 7:
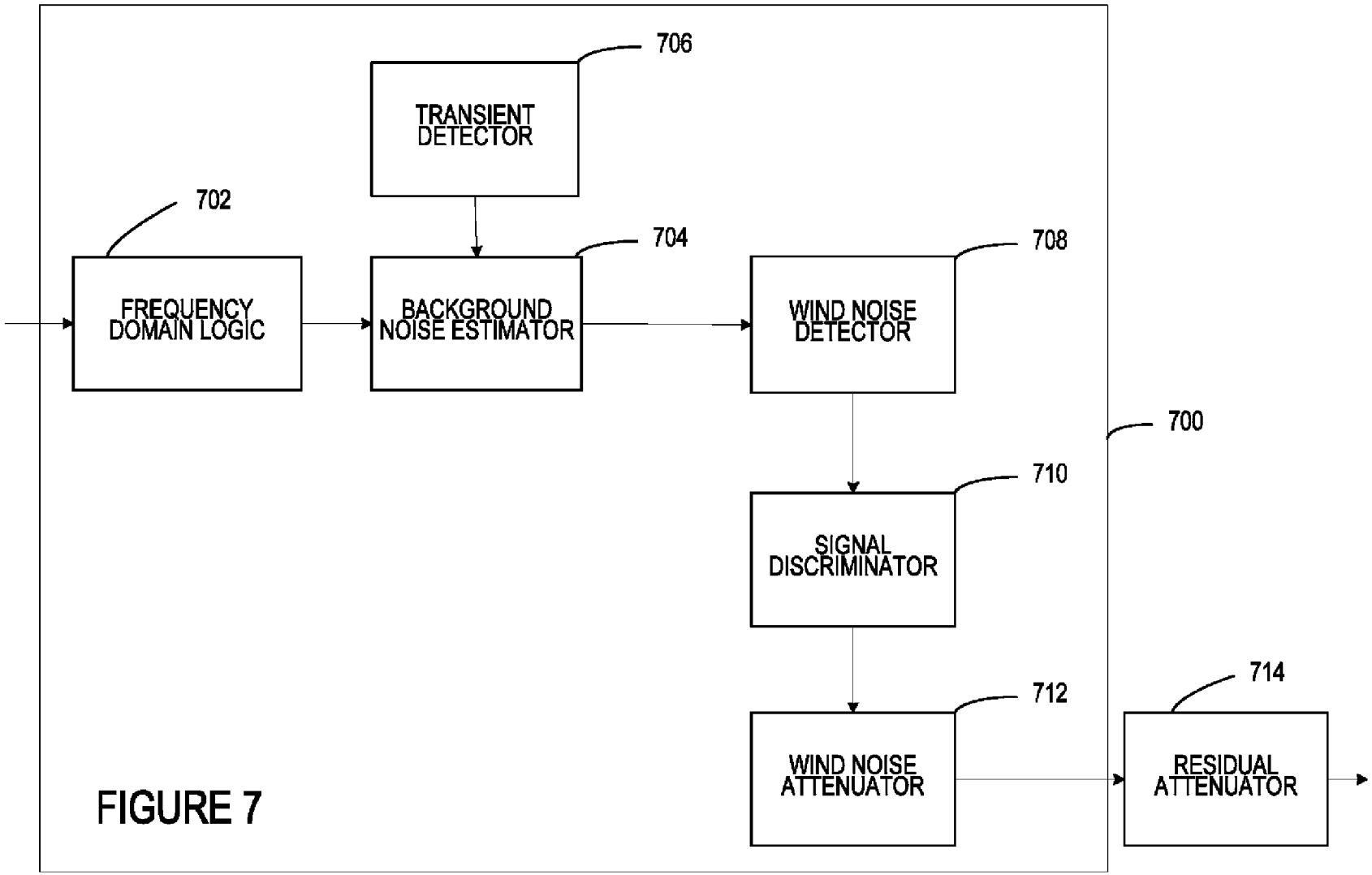
FIG. 7 is a block diagram of an alternative voice enhancement system.

FIG. 7 is alternative voice enhancement logic 700 that also improves the perceptual quality of a processed voice. The enhancement is accomplished by time-frequency transform logic 702 that digitizes and converts a time varying signal to the frequency domain. A background noise estimator 704 measures the continuous or ambient noise that occurs near a sound source or the receiver. The background noise estimator 704 may comprise a power detector that averages the acoustic power in each frequency bin. To prevent biased noise estimations at transients, a transient detector 706 disables the noise estimation process during abnormal or unpredictable increases in power. In FIG. 7, the transient detector 706 disables the background noise estimator 704 when an instantaneous background noise B(f, i) exceeds an average background noise $B(f)_{Ave}$ by more than a selected decibel level 'c.' This relationship may be expressed as:

$$B(f,i)>B(f)_{Ave}+c \qquad \text{(Equation 2)}$$

Figure 8:
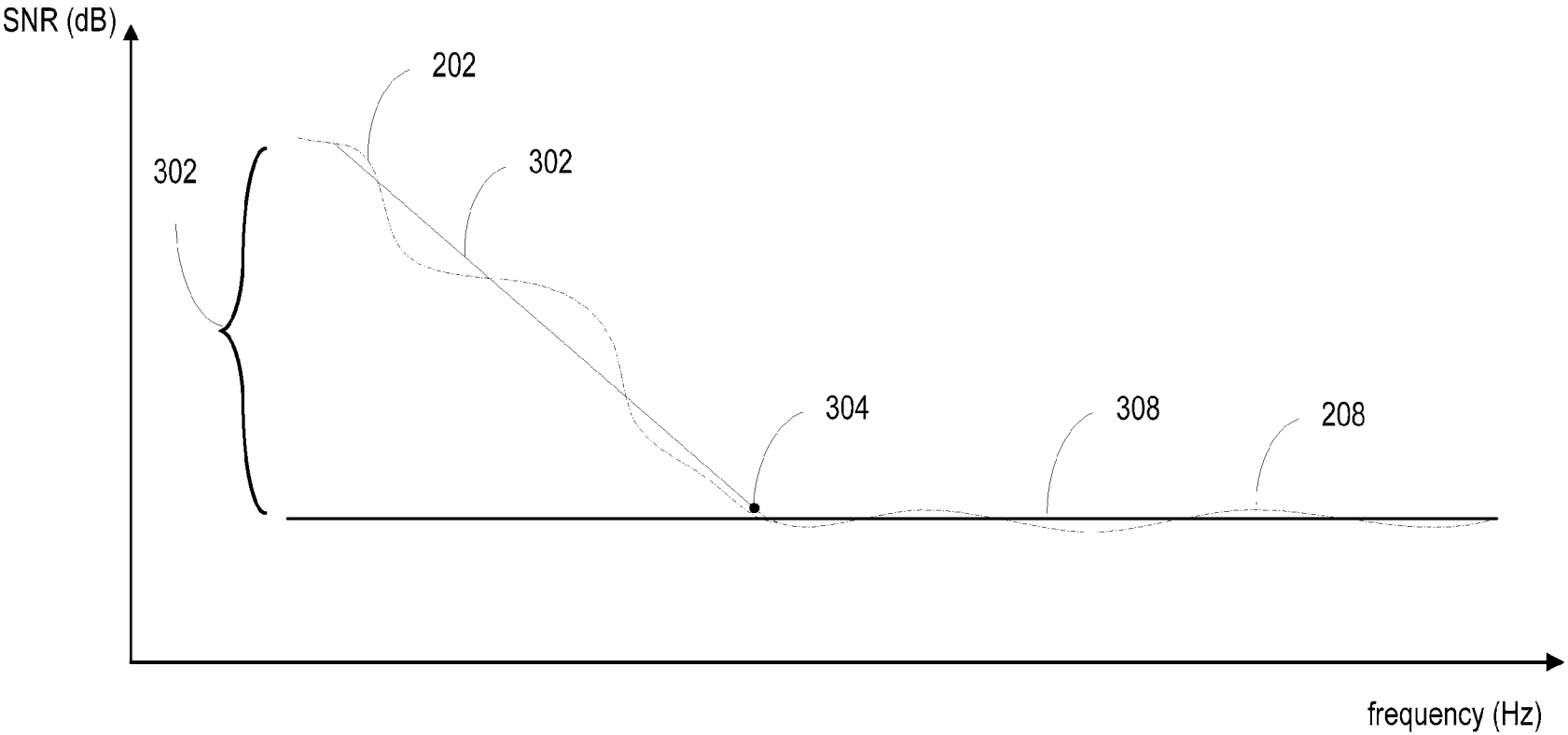
FIG. 8 is noise that may be associated with wind and other sources in the frequency domain.

To detect a wind buffet, a wind noise detector 708 may fit a line to a selected portion of the spectrum in the SNR domain. Through a regression, a best-fit line may model the severity of the wind noise 202, as shown in FIG. 8. To limit any masking of voice, the fitting of the line to a suspected wind buffet may be constrained by the rules described above. A wind buffet may be identified when the offset or y-intercept of the line exceeds a predetermined threshold or when there is a high correlation between a fitted line and the noise associated with a wind buffet. Whether or not a high correlation exists, may depend on a desired clarity of a processed voice and the variations in frequency and amplitude of the wind buffet.

Alternatively, a wind buffet may be identified by the analysis of time varying spectral characteristics of the input signal that may be graphically displayed on a spectrograph. A spectrograph may produce a two dimensional pattern called a spectrogram in which the vertical dimensions correspond to frequency and the horizontal dimensions correspond to time.

A signal discriminator 710 may mark the voice and noise of the spectrum in real or delayed time. Any method may be used to distinguish voice from noise. In FIG. 7, voiced signals may be identified by (1) the narrow widths of their bands or peaks; (2) the resonant structure that may be harmonically related; (3) the resonances or broad peaks that correspond to formant frequencies; (4) characteristics that change relatively slowly with time; (5) their durations; and when multiple detectors or microphones are used, (6) the correlation of the output signals of the detectors or microphones.

To overcome the effects of wind noise, a wind noise attenuator 712 may dampen or substantially remove the wind buffet from the noisy spectrum by any method. One method may add the substantially linear wind buffet model to a recorded or modeled continuous noise. In the power spectrum, the modeled noise may then be removed from the unmodified spectrum by the means described above. If an underlying peak or valley 902 is masked by a wind buffet 202 as shown in FIG. 9 or masked by a continuous noise, a conventional or modified interpolation method may be used to reconstruct the peak and/or valley as shown in FIG. 10. A linear or step-wise interpolator may be used to reconstruct the missing part of the signal. A time series synthesizer may then be used to convert the signal power to the time domain, which provides a reconstructed voice signal.

To minimize the "musical noise," squeaks, squawks, chirps, clicks, drips, pops, low frequency tones, or other sound artifacts that may be generated in the low frequency range by some wind noise attenuators, an optional residual attenuator 714 may also be used. The residual attenuator 714 may track the power spectrum within a low frequency range. When a large increase in signal power is detected an improvement may be obtained by limiting the transmitted power in the low frequency range to a predetermined or calculated threshold. A calculated threshold may be equal to or based on the average spectral power of that same low frequency range at a period earlier in time.

Figure 11:
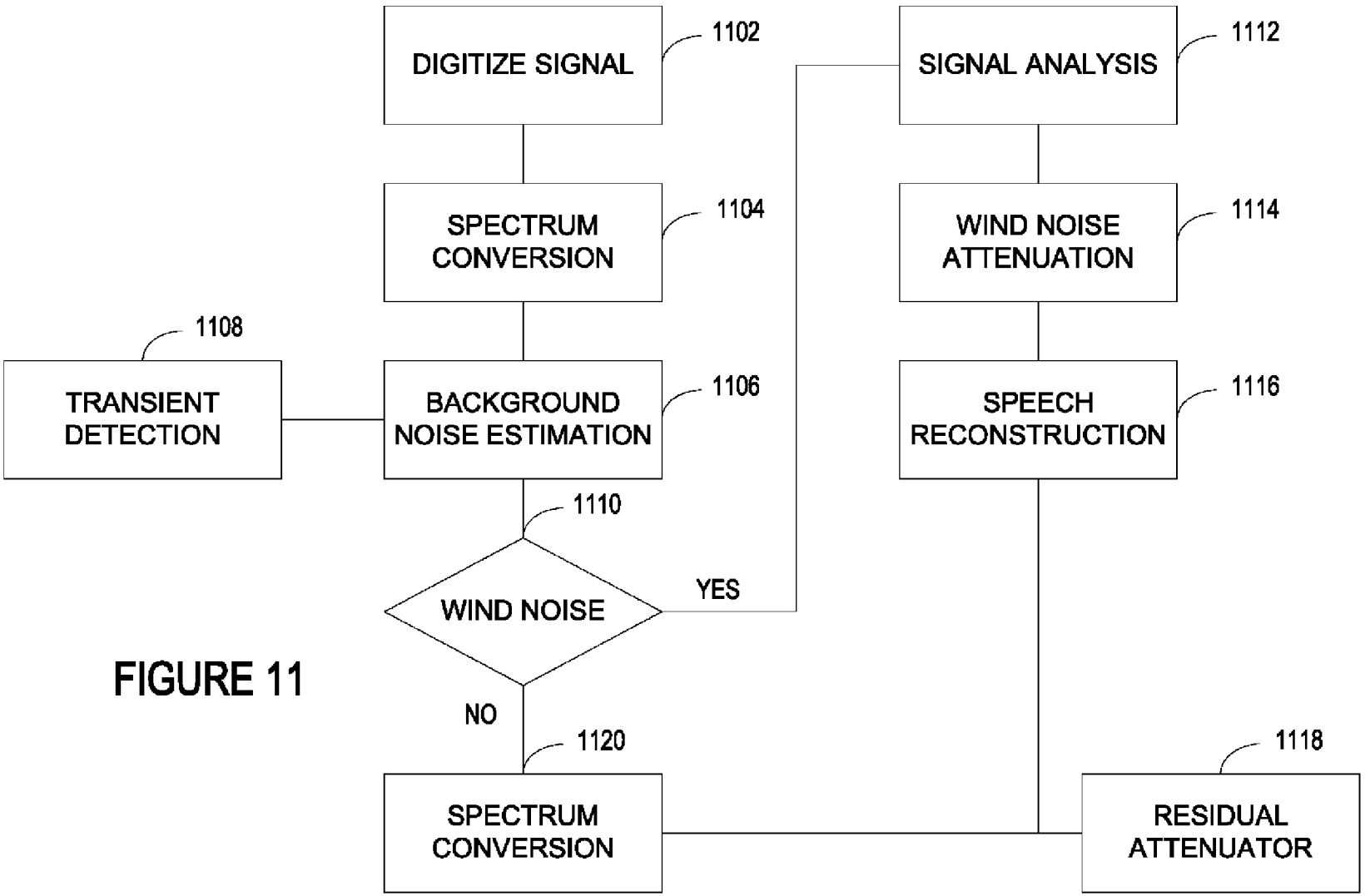
FIG. 11 is a flow diagram of a voice enhancement.

FIG. 11 is a flow diagram of a voice enhancement that removes some wind buffets and continuous noise to enhance the perceptual quality of a processed voice. At act 1102 a received or detected signal is digitized at a predetermined frequency. To assure a good quality voice, the voice signal may be converted to a PCM signal by an ADC. At act 1104 a complex spectrum for the windowed signal may be obtained by means of an FFT that separates the digitized signals into frequency bins, with each bin identifying an amplitude and a phase across a small frequency range.

At act 1106, a continuous or ambient noise is measured. The background noise estimate may comprise an average of the acoustic power in each frequency bin. To prevent biased noise estimations at transients, the noise estimation process may be disabled during abnormal or unpredictable increases in power at act 1108. The transient detection act 1108 disables the background noise estimate when an instantaneous background noise exceeds an average background noise by more than a predetermined decibel level.

At act 1110, a wind buffet may be detected when the offset exceeds a predetermined threshold (e.g., a threshold >3 dB) or when a high correlation exits between a best-fit line and the low frequency spectrum. Alternatively, a wind buffet may be identified by the analysis of time varying spectral characteristics of the input signal. When a line fitting detection method is used, the fitting of the line to the suspected wind buffet signal may be constrained by some optional acts. Exemplary optional acts may prevent a calculated offset, slope, or coordinate point in a wind buffet model from exceeding an average value. Another optional act may prevent the wind noise detection method from applying a calculated wind buffet correction when a vowel or another harmonic structure is detected. If a vowel or another harmonic structure is detected, the wind noise detection method may limit the wind buffet correction to values less than or equal to average values. An additional optional act may allow the average wind buffet model or attributes to be updated only during unvoiced segments. If a voiced or mixed voice segment is detected, the average wind buffet model or attributes are not updated under this act. If no voice is detected, the wind buffet model or each attribute may be updated through many means, such as through a weighted average or a leaky integrator. Many other optional acts may also be applied to the model.

At act 1112, a signal analysis may discriminate or mark the voice signal from the noise-like segments. Voiced signals may be identified by, for example, (1) the narrow widths of their bands or peaks; (2) the resonant structure that may be harmonically related; (3) their harmonics that correspond to formant frequencies; (4) characteristics that change relatively slowly with time; (5) their durations; and when multiple detectors or microphones are used, (6) the correlation of the output signals of the detectors or microphones.

To overcome the effects of wind noise, a wind noise is substantially removed or dampened from the noisy spectrum by any act. One exemplary act 1114 adds the substantially linear wind buffet model to a recorded or modeled continuous noise. In the power spectrum, the modeled noise may then be substantially removed from the unmodified spectrum by the methods and systems described above. If an underlying peak or valley 902 is masked by a wind buffet 202 as shown in FIG. 9 or masked by a continuous noise, a conventional or modified interpolation method may be used to reconstruct the peak and/or valley at act 1116. A time series synthesis may then be used to convert the signal power to the time domain at act 1120, which provides a reconstructed voice signal.

To minimize the "musical noise," squeaks, squawks, chirps, clicks, drips, pops, low frequency tones, or other sound artifacts that may be generated in the low frequency range by some wind noise processes, a residual attenuation method may also be performed before the signal is converted back to the time domain. An optional residual attenuation method 1118 may track the power spectrum within a low frequency range. When a large increase in signal power is detected an improvement may be obtained by limiting the transmitted power in the low frequency range to a predetermined or calculated threshold. A calculated threshold may be equal to or based on the average spectral power of that same low frequency range at a period earlier in time.

Figure 12:
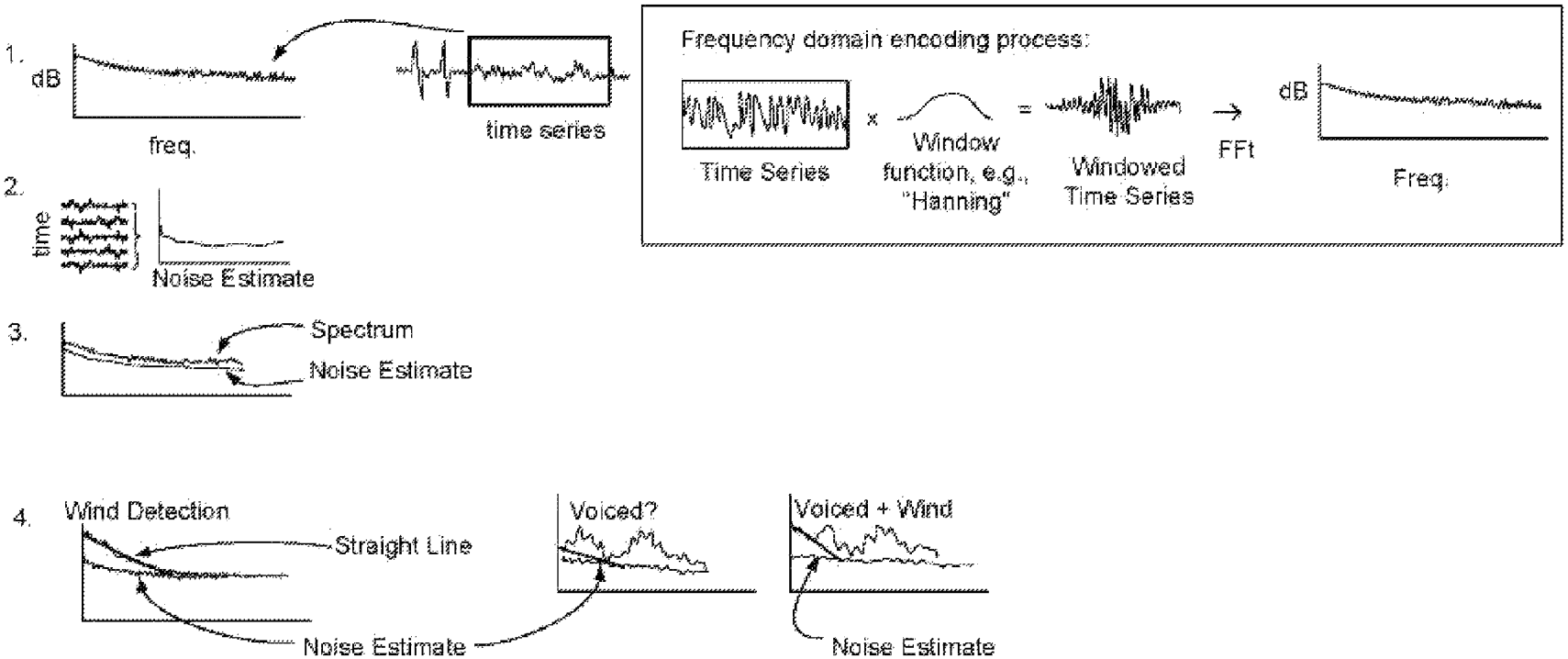
FIG. 12 is a partial sequence diagram of a voice enhancement.
Figure 13:
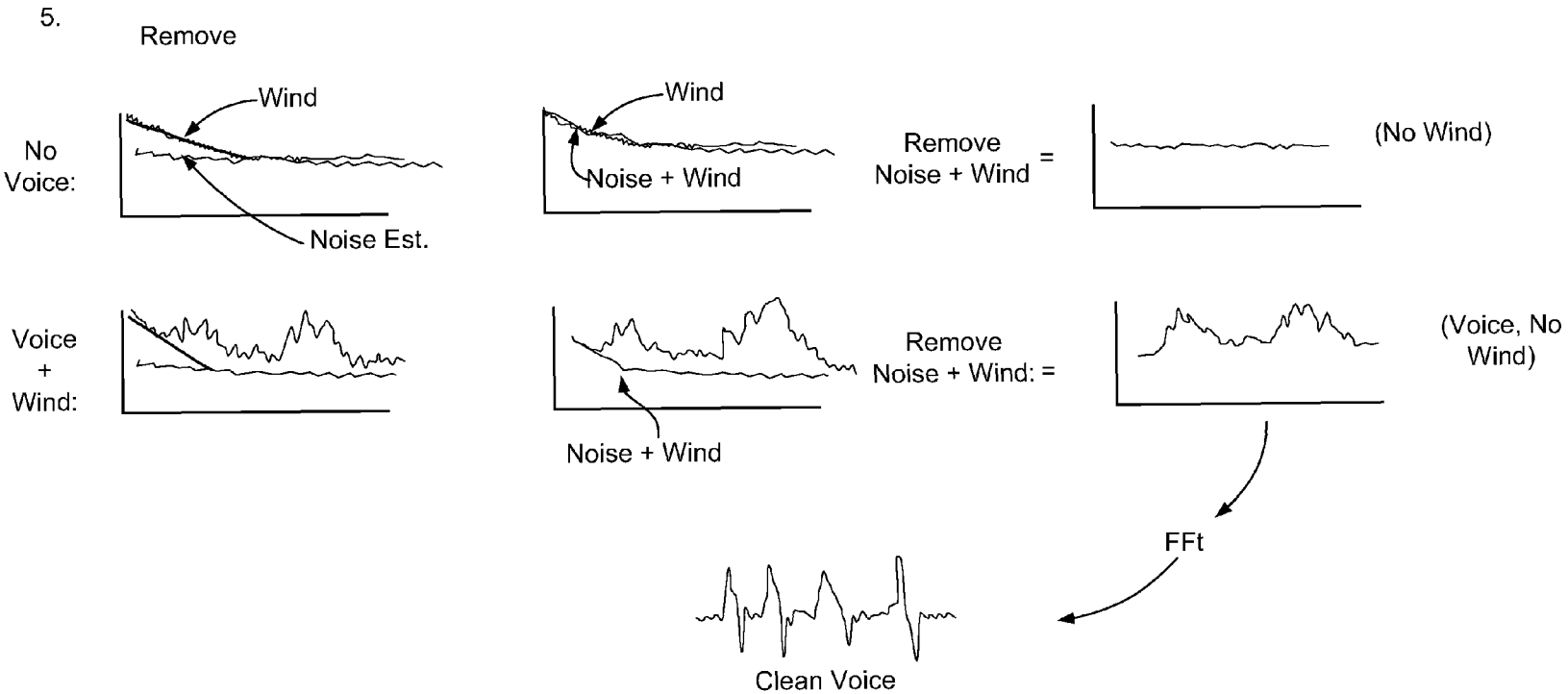
FIG. 13 is a partial sequence diagram of a voice enhancement.

FIGS. 12 and 13 are partial sequence diagrams of a voice enhancement. Like the method shown in FIG. 11, the sequence diagrams may be encoded in a signal bearing medium, a computer readable medium such as a memory, programmed within a device such as one or more integrated circuits, or processed by a controller or a computer. If the methods are performed by software, the software may reside in a memory resident to or interfaced to the wind noise detector 102, a communication interface, or any other type of non-volatile or volatile memory interfaced or resident to the voice enhancement logic 100 or 700. The memory may include an ordered listing of executable instructions for implementing logical functions. A logical function may be implemented through digital circuitry, through source code, through analog circuitry, or through an analog source such through an analog electrical, audio, or video signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine-readable medium," "propagated-signal" medium, and/or "signal-bearing medium" may comprise any means that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM" (electronic), a Read-Only Memory "ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

As shown in the first sequence of FIG. 12, a time series signal may be digitized and smoothed by a Hanning window to provide an accurate estimation of a fully voiced, a mixed voice, or an unvoiced segment. The complex spectrum for the windowed signal is obtained by means of an FFT that separates the digitized signals into frequency bins, with each bin identifying an amplitude across a small frequency range.

In the second sequence, an averaging of the acoustic power in each frequency bin during unvoiced segments derives the background noise estimate. To prevent biased noise estimates, noise estimates may not occur when abnormal or unpredictable power fluctuations are detected.

In the third sequence, the unmodified spectrum is digitized, smoothed by a window, and transformed into the complex spectrum by an FFT. The unmodified spectrum exhibits portions containing noise-like segments and other portions exhibiting a regular harmonic structure.

In the fourth sequence, a sound segment is fitted to separate lines to model the severity of the wind and continuous noise. To provide a more complete explanation, an unvoiced, fully voiced, and mixed voiced sample are shown. The frequency bins in each sample were converted into the power-spectral domain and logarithmic domain to develop a wind buffet and continuous noise estimate. As more windows are processed, the average wind noise and continuous noise estimates are derived.

To detect a wind buffet, a line is fitted to a selected portion of the signal in the SNR domain. Through a regression, best-fit lines model the severity of the wind noise in each illustration. A high correlation between one best-fit line and the low frequency spectrum may identify a wind buffet. Alternatively, a y-intercept that exceeds a predetermined threshold may also identify a wind buffet. To limit the masking of voice, the fitting of the line to a suspected wind buffet signal may be constrained by the rules described above.

To overcome the effects of wind noise, the modeled noise may be dampened in the unmodified spectrum. In FIG. 13, the dampening of the wind buffets and continuous noise from the unvoiced and mixed voiced sample are shown in the fifth sequence. An inverse FFT that converts the signal power to the time domain provides the reconstructed voice signal.

From the foregoing descriptions it should be apparent that the above-described systems may condition signals received from only one microphone or detector. It should also be apparent, that many combinations of systems may be used to identify and track wind buffets. Besides the fitting of a line to a suspected wind buffet, a system may (1) detect the peaks in the spectra having a SNR greater than a predetermined threshold; (2) identify the peaks having a width greater than a predetermined threshold; (3) identify peaks that lack a harmonic relationships; (4) compare peaks with previous voiced spectra; and (5) compare signals detected from different microphones before differentiating the wind buffet segments, other noise like segments, and regular harmonic structures. One or more of the systems described above may also be used in alternative voice enhancement logic.

Other alternative voice enhancement systems include combinations of the structure and functions described above. These voice enhancement systems are formed from any combination of structure and function described above or illustrated within the attached figures. The logic may be implemented in software or hardware. The term "logic" is intended to broadly encompass a hardware device or circuit, software, or a combination. The hardware may include a processor or a controller having volatile and/or non-volatile memory and may also include interfaces to peripheral devices through wireless and/or hardwire mediums.

Figure 14:
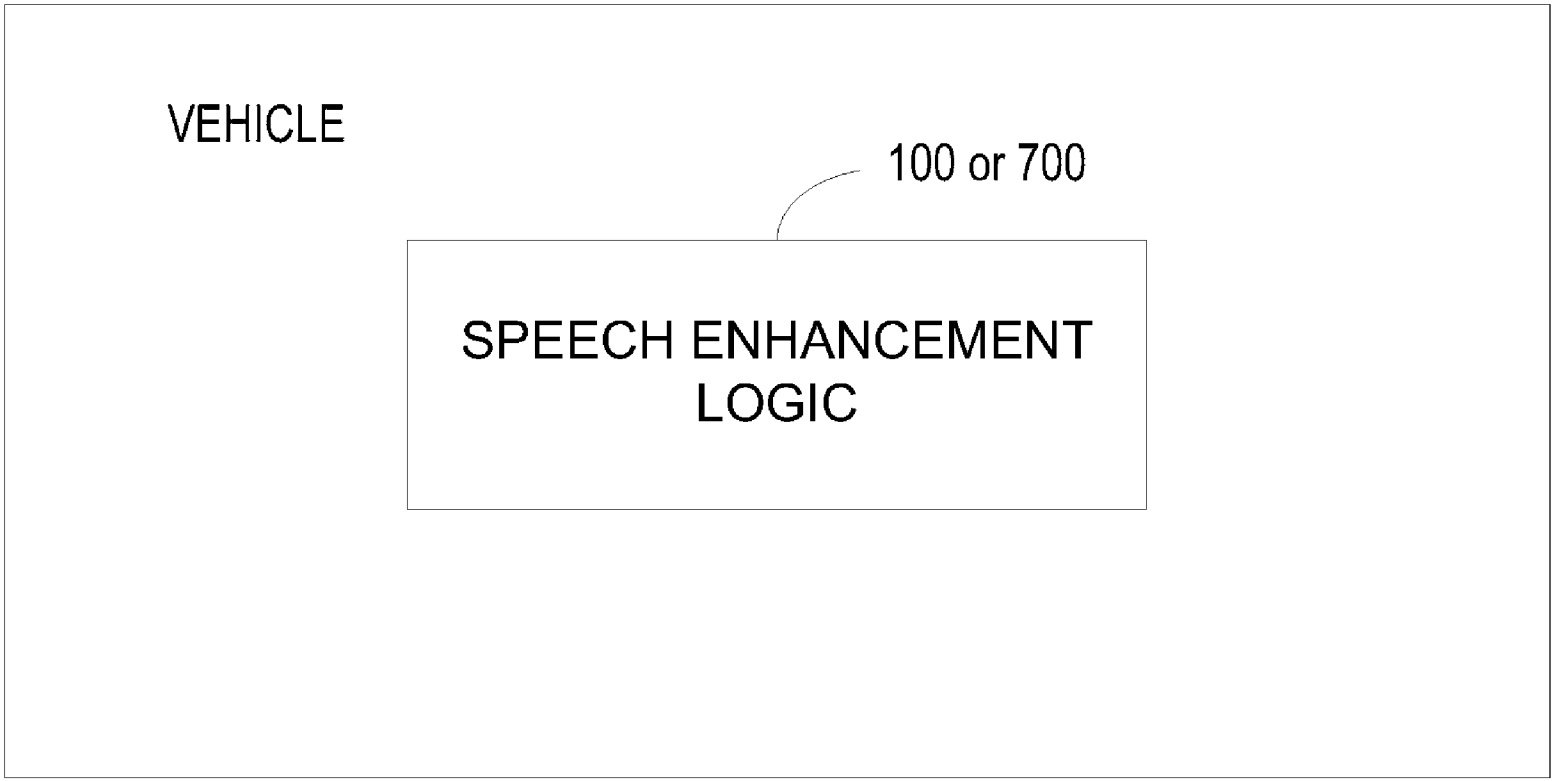
FIG. 14 is a block diagram of voice enhancement logic within a vehicle.
Figure 15:
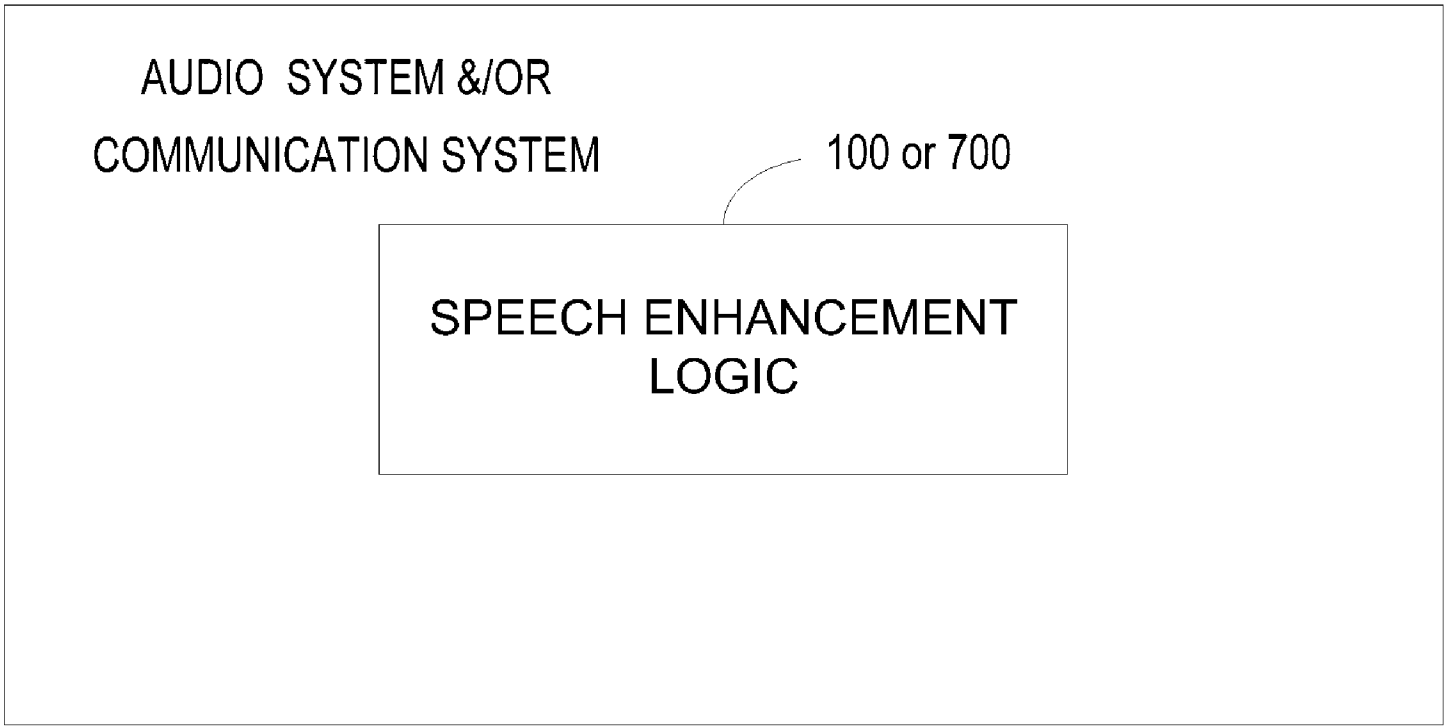
FIG. 15 is a block diagram of voice enhancement logic interfaced to an audio system and/or a communication system.

The voice enhancement logic is easily adaptable to any technology or devices. Some voice enhancement systems or components interface or couple vehicles as shown in FIG. 14, instruments that convert voice and other sounds into a form that may be transmitted to remote locations, such as landline and wireless telephones and audio equipment as shown in FIG. 15, and other communication systems that may be susceptible to wind noise.

The voice enhancement logic improves the perceptual quality of a processed voice. The logic may automatically learn and encode the shape and form of the noise associated with the movement of air in a real or a delayed time. By tracking selected attributes, the logic may eliminate or dampen wind noise using a limited memory that temporarily or permanently stores selected attributes of the wind noise. The voice enhancement logic may also dampen a continuous noise and/or the squeaks, squawks, chirps, clicks, drips, pops, low frequency tones, or other sound artifacts that may be generated within some voice enhancement systems and may reconstruct voice when needed.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A system for suppressing wind noise, comprising:

a wind noise detector configured to identify whether an input signal contains a wind buffet by fitting a line to at least a portion of the input signal in a signal-to-noise ratio domain; and a wind noise attenuator electrically connected to the wind noise detector to attenuate the wind buffet in the input signal in response to the wind noise detector identifying that the input signal contains the wind buffet.

2. The system of claim 1, where the wind noise detector is configured to identify whether the input signal contains the wind buffet based on a correlation between the line and the portion of the input signal.

3. The system of claim 1, where the line comprises a straight linear model, and where the wind noise detector is configured to fit the straight linear model to the portion of the input signal through a best-fit linear regression.

4. The system of claim 1, where the wind noise detector is configured to identify whether the input signal contains the wind buffet based on a calculated offset or a y-intercept of the line fit to the portion of the input signal.

5. The system of claim 4, where the wind noise detector is configured to compare the calculated offset or the y-intercept to a predetermined threshold and identify that the input signal contains the wind buffet when the calculated offset or the y-intercept exceeds the predetermined threshold.

6. The system of claim 1, where the wind noise detector is configured to model the line to a portion of a low frequency spectrum of the input signal.

7. The system of claim 1, where the wind noise detector is configured to analyze an average wind buffet model, and where the wind noise detector is configured to derive the average wind buffet model by a weighted average of modeled signals analyzed earlier in time.

8. The system of claim 7, where the wind noise detector is configured to prevent a newly calculated value of a selected attribute of the average wind buffet model from exceeding an average value.

9. The system of claim 7, where the wind noise detector is configured to forgo updating the average wind buffet model when a voiced or a mixed voice signal is detected.

10. The system of claim 1, where the wind noise detector is configured to limit a wind buffet correction when a vowel or a harmonic like structure is detected.

11. The system of claim 1, further comprising a residual attenuator electrically coupled to the wind noise detector and the wind noise attenuator to dampen signal power in a low frequency range when a large increase in a signal power is detected in the low frequency range.

12. The system of claim 1, where the wind noise detector comprises a processor, a non-transitory computer-readable medium, or a circuit.

13. A method of dampening a wind buffet from an input signal, comprising:

fitting a line to at least a portion of the input signal;

detecting, by a wind noise detector that comprises a processor, a non-transitory computer-readable medium, or a circuit, that the input signal contains the wind buffet based on a correlation between the line and the portion of the input signal; and dampening the wind buffet in the input signal to obtain a noise-reduced signal.

14. The method of claim 13, where the line comprises a straight linear model, and where the act of fitting comprises fitting the straight linear model to the portion of the input signal in a signal-to-noise ratio domain through a best-fit linear regression.

15. The method of claim 13, where the act of detecting comprises applying wind buffet line fitting rules to the line to obtain a constrained line adhering to the wind buffet line fitting rules.

16. A method of dampening a wind buffet from an input signal, comprising:

fitting a line to at least a portion of the input signal;

calculating an offset or a y-intercept of the line fit to the portion of the input signal;

detecting, by a wind noise detector that comprises a processor, a non-transitory computer-readable medium, or a circuit, that the input signal contains the wind buffet based on a comparison between the calculated offset or the y-intercept and a predetermined threshold; and dampening the wind buffet in the input signal to obtain a noise-reduced signal.

17. The method of claim 16, where the line comprises a straight linear model, and where the act of fitting comprises fitting the straight linear model to the portion of the input signal in a signal-to-noise ratio domain through a best-fit linear regression.

18. The method of claim 16, where the act of detecting comprises:

comparing the calculated offset or the y-intercept to the predetermined threshold; and identifying that the input signal contains the wind buffet when the calculated offset or the y-intercept exceeds the predetermined threshold.

19. A product, comprising:

a non-transitory computer readable storage medium; and logic stored on the non-transitory computer readable storage medium for execution by a processor for causing the processor to:

fit a line to at least a portion of an input signal;

detect that the input signal contains a wind buffet based on a correlation between the line and the portion of the input signal; and dampen the wind buffet in the input signal to obtain a noise-reduced signal.

20. The product of claim 19, where the line comprises a straight linear model, and where the logic for causing the processor to fit the line comprises logic for causing the processor to fit the straight linear model to the portion of the input signal in a signal-to-noise ratio domain through a best-fit linear regression.

* * * * *